US010677490B2

(12) United States Patent
Lo et al.

(10) Patent No.: US 10,677,490 B2
(45) Date of Patent: Jun. 9, 2020

(54) COMPENSATIONAL CONTROL SYSTEM FOR INDOOR AIR CONDITIONING APPARATUSES AND COMPENSATIONAL CONTROL METHOD FOR THE SAME

(71) Applicant: Delta Electronics, Inc., Taoyuan (TW)

(72) Inventors: Tien-Szu Lo, Taoyuan (TW); Meng-Seng Chen, Taoyuan (TW); Hsiang-Pin Lee, Taoyuan (TW); Ying-Hsiu Chen, Taoyuan (TW)

(73) Assignee: DELTA ELECTRONICS, INC., Taoyuan (TW)

( * ) Notice: Subject to any disclaimer, the term of this patent is extended or adjusted under 35 U.S.C. 154(b) by 41 days.

(21) Appl. No.: 15/870,903

(22) Filed: Jan. 13, 2018

(65) Prior Publication Data

US 2018/0328615 A1 Nov. 15, 2018

(30) Foreign Application Priority Data

May 10, 2017 (CN) ..... 2017 1 0325745

(51) Int. Cl.
*F24F 11/74* (2018.01)
*F24F 11/30* (2018.01)
(Continued)

(52) U.S. Cl.
CPC ..... *F24F 11/745* (2018.01); *F24F 11/30* (2018.01); *F24F 11/63* (2018.01); *F24F 11/74* (2018.01);
(Continued)

(58) Field of Classification Search
CPC ..... F24F 11/745; F24F 11/63; F24F 11/74; F24F 11/81; F24F 11/30; F24F 11/523;
(Continued)

(56) References Cited

U.S. PATENT DOCUMENTS

2008/0140259 A1* 6/2008 Bash ..... G05D 23/192 700/278
2015/0045967 A1* 2/2015 Mori ..... F24F 3/065 700/277

(Continued)

*Primary Examiner* — Thomas C Lee
*Assistant Examiner* — Anzuman Sharmin
(74) *Attorney, Agent, or Firm* — Hauptman Ham, LLP

(57) ABSTRACT

A compensational control method includes the steps of: controlling a plurality of indoor air conditioning apparatuses to be in operation according to a target temperature; receiving continuously an operating parameter and an environmental datum from each of the indoor air conditioning apparatus; determining whether there is a specific indoor air conditioning apparatus that needs support; acquiring an adjacent indoor air conditioning apparatus which is influential for the specific indoor air conditioning apparatus according to an influence form which is previously built; establishing a supportive strategy according to a supportable operation capability of the adjacent indoor air conditioning apparatus; and adjusting the operating parameter of the adjacent indoor air conditioning apparatus according to the supportive strategy. Therefore, the adjacent indoor air conditioning apparatus is provided to improve an ambient temperature of an area where the specific indoor air conditioning apparatus is installed.

14 Claims, 10 Drawing Sheets

(51) Int. Cl.

| | |
|---|---|
| ***F24F 11/81*** | (2018.01) |
| ***F24F 11/63*** | (2018.01) |
| ***F24F 11/61*** | (2018.01) |
| ***F24F 11/64*** | (2018.01) |
| ***F24F 11/46*** | (2018.01) |
| ***F24F 11/58*** | (2018.01) |
| ***F24F 11/523*** | (2018.01) |
| ***F24F 140/50*** | (2018.01) |
| ***F24F 110/10*** | (2018.01) |

(52) U.S. Cl.
CPC ..... *F24F 11/81* (2018.01); *F24F 11/46* (2018.01); *F24F 11/523* (2018.01); *F24F 11/58* (2018.01); *F24F 11/61* (2018.01); *F24F 11/64* (2018.01); *F24F 2110/10* (2018.01); *F24F 2140/50* (2018.01); *F24F 2221/54* (2013.01)

(58) Field of Classification Search
CPC ..... F24F 2140/50; F24F 11/64; F24F 11/46; F24F 2110/10; F24F 11/58; F24F 11/61; F24F 2221/54
See application file for complete search history.

(56) References Cited

U.S. PATENT DOCUMENTS

| | | | | |
|---|---|---|---|---|
| 2018/0216843 | A1* | 8/2018 | Zhou | F24F 7/06 |
| 2018/0372345 | A1* | 12/2018 | Fischer | F28F 27/00 |
| 2019/0041080 | A1* | 2/2019 | Higuchi | F24F 11/30 |

* cited by examiner

COMPENSATIONAL CONTROL SYSTEM FOR INDOOR AIR CONDITIONING APPARATUSES AND COMPENSATIONAL CONTROL METHOD FOR THE SAME

BACKGROUND

Technical Field

The present invention relates to an indoor air conditioning apparatus, and more particularly to a compensational control system for indoor air conditioning apparatuses and a compensational control method for the same.

Description of Related Art

Nowadays, the commonly used air conditioning system on the market includes a central air conditioning system and a varied refrigerant volume (VRV) air conditioning system.

Unlike the central air conditioning system, the VRV air conditioning system has an outdoor air conditioning apparatus and several indoor air conditioning apparatuses. In general, each of the indoor air conditioning apparatuses is responsible for controlling the ambient temperature and humidity of an area where the indoor air conditioning apparatus is installed. Therefore, operating parameters of the air conditioning apparatuses located in different areas are not the same and the air conditioning apparatuses may not communicate and interfere with each other.

In general, some buildings are divided their inner space into several areas and rented to different users. Since different users have different temperature and humidity requirements for the environment, and the VRV air conditioning system is usually used to meet the user's need to set the operating parameter of the located indoor air conditioning apparatus.

However, the original areas may be possibly changed depending on actual demands, for example, two divided areas are merged into a single open one. If there are several indoor air conditioning apparatuses are installed in the single open area or different indoor air conditioning apparatuses are influenced by each other because multiple divided areas are communicated with one another, and each of the indoor air conditioning apparatuses is in operation but fails to refer to other indoor air conditioning apparatuses, thereby easily causing the electricity waste due to the power consumption and the ambient temperatures and humidity of the areas where the indoor air conditioning apparatuses are installed are imbalanced.

SUMMARY

An objective of the present invention is to provide a compensational control system for indoor air conditioning apparatuses and a compensational control method thereof to solve the above-mentioned problems. When one of the indoor air conditioning apparatuses is short of capacity, the other adjacent indoor air conditioning apparatus is controlled and adjusted to support such one.

In order to achieve the above-mentioned objective, the compensational control method of the present invention includes several steps of: controlling several indoor air conditioning apparatuses to be in operation by the control unit according to a target temperature; receiving continuously an operating parameter and an environmental datum provided from each of the indoor air conditioning apparatuses; determining whether there is a specific indoor air conditioning apparatus that needs support according to the operating parameters and the environmental data; acquiring an adjacent indoor air conditioning apparatus which is influential for the specific indoor air conditioning apparatus according to an influence form which is previously built; establishing a supportive strategy according to a supportable operation capability of the adjacent indoor air conditioning apparatus; and adjusting the operating parameter of the adjacent indoor air conditioning apparatus according to the supportive strategy.

In order to achieve the above-mentioned objective, the compensational control system for indoor air conditioning apparatuses is applied to the compensational control method of the present invention. The compensational control system includes a control unit and several indoor air conditioning apparatuses. The control unit determines a target temperature to be reached for different areas in a space. The indoor air conditioning apparatuses are connected to the control unit and receive the target temperature, and each of the indoor air conditioning apparatus being in operation according to its target temperature and continuously providing an operating parameter and an environmental datum to the control unit. The control unit acquires an adjacent indoor air conditioning apparatus which is influential for the specific indoor air conditioning apparatus according to an influence form which is previously built when the control unit determines one of the indoor air conditioning apparatuses that needs support according to the operating parameters and the environmental data, establishes a supportive strategy according to a supportable operation capability of each adjacent indoor air conditioning apparatus, and adjusts the operating parameter of the adjacent indoor air conditioning apparatus according to the supportive strategy.

In comparison with the related art, the operating parameter of the adjacent indoor air conditioning apparatus can be adjusted to support the indoor air conditioning apparatus which is short of capacity operated in a cooling mode or a heating mode so as to improve the ambient temperatures and humidity of the areas where the indoor air conditioning apparatuses are installed.

Moreover, any one of the indoor air conditioning apparatuses can be controlled to adjacently support other indoor air conditioning apparatuses and the operating parameters of the indoor air conditioning apparatuses can be adjusted to be coincident so as to reduce the overall power consumption.

It is to be understood that both the foregoing general description and the following detailed description are exemplary, and are intended to provide further explanation of the present invention as claimed. Other advantages and features of the present invention will be apparent from the following description, drawings and claims.

BRIEF DESCRIPTION OF DRAWING

The present invention can be more fully understood by reading the following detailed description of the embodiment, with reference made to the accompanying drawings as follows.

DETAILED DESCRIPTION

Figure 1:
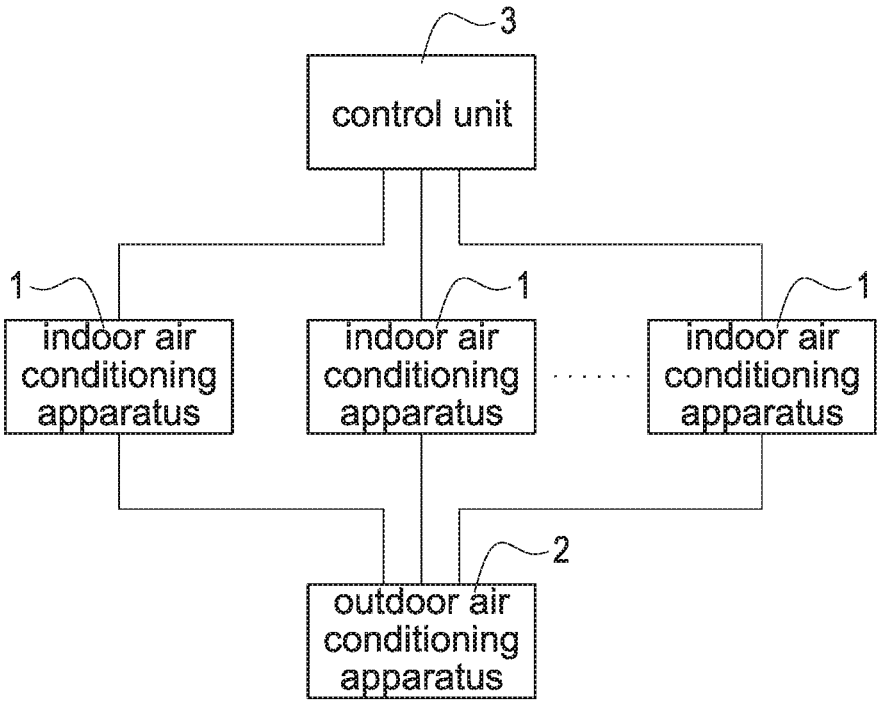
FIG. 1 is a schematic block diagram of a control system according to a first embodiment of the present invention.

Reference will now be made to the drawing figures to describe the present invention in detail. It will be understood that the drawing figures and exemplified embodiments of present invention are not limited to the details thereof.

The present invention discloses a compensational control system for indoor air conditioning apparatuses (hereinafter referred to as "control system"). The control system may be, for example but not limited to, a varied refrigerant volume (VRV) air conditioning system, and the VRV air conditioning system is used to improve ambient temperatures of multiple areas in a space.

FIG. 1 shows a schematic block diagram of a control system according to a first embodiment of the present invention. Referring to FIG. 1, the control system mainly includes several indoor air conditioning apparatuses 1, an outdoor air conditioning apparatus 2, and a control unit 3. The outdoor air conditioning apparatus 2 is connected to the indoor air conditioning apparatuses 1, and the control unit 3 is connected to the indoor air conditioning apparatuses 1. These indoor air conditioning apparatuses 1 are installed inside the space for adjusting the temperature inside the space, and the outdoor air conditioning apparatus 2 is installed outside the space for outwardly removing the heat generated inside the space.

In one embodiment, the control unit 3 is connected to the indoor air conditioning apparatuses 1 by a wired manner, such as a transmission line or a power line, or a wireless manner, such as a Bluetooth-based wireless connection or a ZigBee-based wireless connection, and the control unit 3 may be also installed inside the same space. In another embodiment, the control unit 3 may be installed on a cloud server, and wirelessly connected to the indoor air conditioning apparatuses 1 by an Internet connection. More specifically, the control unit 3 may be a server, a personal computer, a tablet computer, an embedded system, or an electronic apparatus, such as a smart mobile apparatus capable of transmitting data and processing data. In the present invention, the control unit 3 is provided to collect information of the indoor air conditioning apparatuses 1 and further control the indoor air conditioning apparatuses 1.

Figure 2:
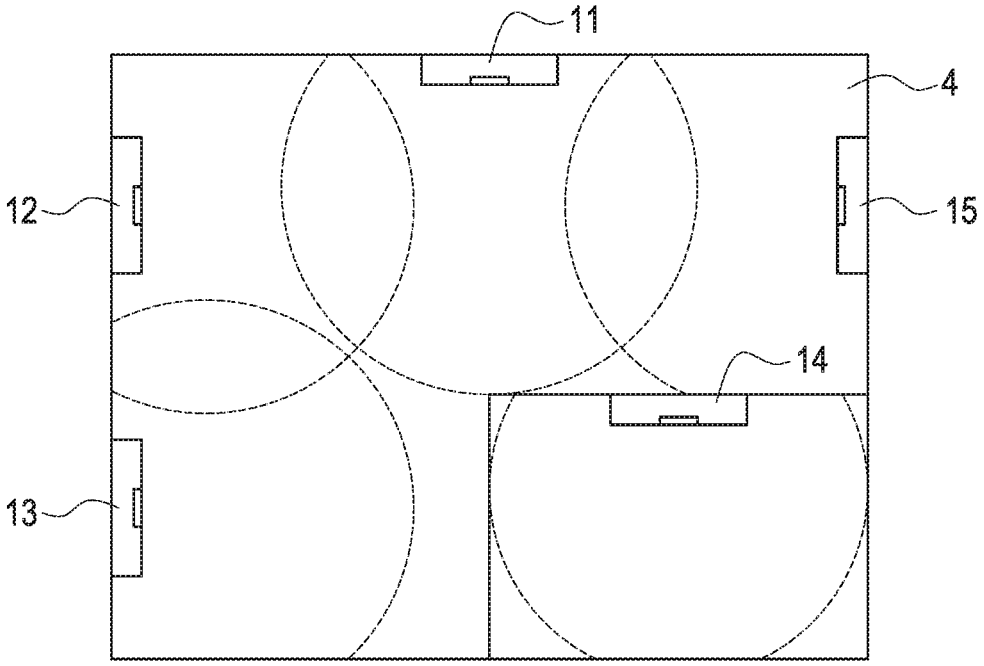
FIG. 2 is a schematic view of a space layout of the control system according to the first embodiment of the present invention.

FIG. 2 shows a schematic view of a space layout of the control system according to the first embodiment of the present invention. Both Referring to FIG. 1 and FIG. 2, the control system includes several indoor air conditioning apparatuses 1 installed inside a space 4, such as a first indoor air conditioning apparatus 11, a second indoor air conditioning apparatus 12, a third indoor air conditioning apparatus 13, a fourth indoor air conditioning apparatus 14, and a fifth indoor air conditioning apparatus 15.

As shown in FIG. 2, the improvable area of the first indoor air conditioning apparatus 11 is overlapped with the improvable area of the second indoor air conditioning apparatus 12, and the improvable area of the first indoor air conditioning apparatus 11 is also overlapped with the improvable area of the fifth indoor air conditioning apparatus 15. In addition, the improvable area of the second indoor air conditioning apparatus 12 is also an improbable area of the third indoor air conditioning apparatus 13. In particular, the improvable area represents the ambient temperature of an area where the indoor air conditioning apparatus 1 operated in a cooling mode and/or a heating mode can be adjusted to improve.

As can be seen from the improvable areas shown in FIG. 2, an ambient temperature of an area where the second indoor air conditioning apparatus 12 is installed in and an ambient temperature of an area where the fifth indoor air conditioning apparatus 15 is installed in are indirectly improved when the first indoor air conditioning apparatus 11 is in operation. Similarly, an ambient temperature of an area where the first indoor air conditioning apparatus 11 is installed in and an ambient temperature of an area where the third indoor air conditioning apparatus 13 is installed in are indirectly improved when the second indoor air conditioning apparatus 12 is in operation. Similarly, the ambient temperature of the area where the second indoor air conditioning apparatus 12 is installed in is indirectly improved when the third indoor air conditioning apparatus 13 is in operation. Similarly, the ambient temperature of the area where the first indoor air conditioning apparatus 11 is installed in is indirectly improved when the fifth indoor air conditioning apparatus 15 is in operation.

As shown in FIG. 2, however, an ambient temperature of a region where the fourth indoor air conditioning apparatus 14 is installed is not indirectly improved no matter which indoor air conditioning apparatus (apart from the fourth indoor air conditioning apparatus 14) is in operation since a region where the fourth indoor air conditioning apparatus 14 is installed is isolated from other regions. For the same reason, none of the ambient temperatures of the regions where the first indoor air conditioning apparatus 11, the second indoor air conditioning apparatus 12, the third indoor air conditioning apparatus 13, and the fifth indoor air conditioning apparatus 15 are installed is indirectly improved when the fourth indoor air conditioning apparatus 14 is in operation.

One of the purposes of the present invention is that the control unit 3 can adjust the operating parameters of other indoor air conditioning apparatuses 1 which are influential for the specific indoor air conditioning apparatus 1 so as to successfully improve the ambient temperature of the area where the specific indoor air conditioning apparatus is installed.

As more specifically shown in FIG. 2, the control unit 3 will adjust an operating parameter of the second indoor air conditioning apparatus 12 and/or an operating parameter of the fifth indoor air conditioning apparatus 15 to support the first indoor air conditioning apparatus 11 once the first indoor air conditioning apparatus 11 fails to improve the ambient temperature of the area where the first indoor air conditioning apparatus 11 is installed. Similarly, the control unit 3 will adjust an operating parameter of the first indoor air conditioning apparatus 11 and/or an operating parameter of the third indoor air conditioning apparatus 13 to support the second indoor air conditioning apparatus 12 once the second indoor air conditioning apparatus 12 fails to improve the ambient temperature of the area where the second indoor air conditioning apparatus 12 is installed.

Figure 3:
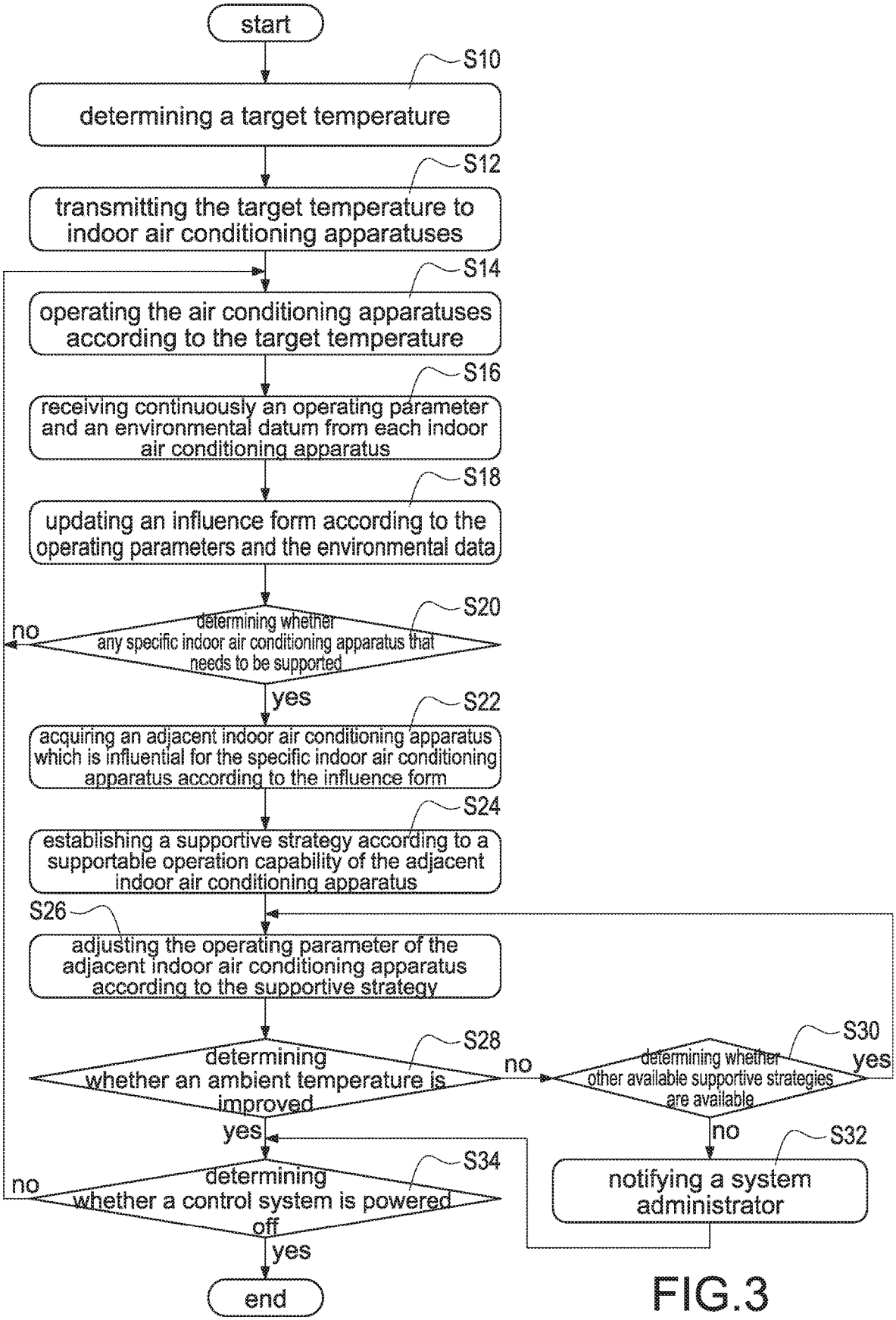
FIG. 3 is a flowchart of a compensational control method according to the first embodiment of the present invention.

The present invention also provides a compensational control method applied to a control system shown in FIG. 1 and FIG. 2 (hereinafter referred to as "control method"). Refer to FIG. 3, which shows a flowchart of a compensational control method according to the first embodiment of the present invention. More specifically, the control unit 3 comes with embedded control codes and all steps shown in FIG. 3 can be performed by executing the embedded control codes of the control unit 3.

Firstly, the control unit 3 determines a target temperature to be reached for different areas in the space according to related information after the control system is activated (S10). Afterward, the control unit 3 correspondingly transmits the target temperatures of the areas where the indoor air conditioning apparatuses 1 are installed in to the indoor air conditioning apparatuses 1 (S12), and each of the indoor air conditioning apparatus 1 is in operation according to its target temperature. For example, when the target temperature is 25° C. and the indoor air conditioning apparatuses 1 receive the target temperature, the ambient temperatures of the areas where the indoor air conditioning apparatuses 1 are installed gradually (rise or fall to) approach 25° C.

In one embodiment, the above-mentioned related information may be, for example but not limited to, current date, current time, current season, outdoor temperature, and so on, that is, the control unit 3 can determine the target temperature according to current date, current time, current season, outdoor temperature, and so on.

More specifically, the control unit 3 can simultaneously confirm the target temperature and a comfortable temperature range corresponding to the target temperature in the step (S10). Also, the control unit 3 controls each of the indoor air conditioning apparatus 1 according to the target temperature and the comfortable temperature range so that each of the indoor air conditioning apparatus 1 can be operated in a more economical manner. For example, if the comfortable temperature range is set as 23.4° C. to 26.2° C., it represents that the user feels comfortable in the comfortable temperature range (23.4° C. to 26.2° C.). Therefore, if the target temperature is 24.8° C., each of the indoor air conditioning apparatus 1 can be operated to maintain the temperature of the area between 24.8° C. and 26.2° C. rather than being kept fixed at the target temperature (24.8° C.) so that each of the indoor air conditioning apparatus 1 of the control system can be operated in a more economical manner.

In one embodiment, the control unit 3 may provide a graphic user interface (GUI) for the user to input the comfortable temperature range. In another embodiment, the control unit 3 may, for example but not limited to, calculate the comfortable temperature range according to a thermal comfortable index—predicted mean vote (PMV). The thermal comfortable index is a commonly used technical indicator in the art, the detail description thereof is omitted here for conciseness.

After the step (S12), each of the indoor air conditioning apparatus 1 is in operation according to the target temperature and the comfortable temperature range (S14). Also, the control unit 3 continuously receives the operating parameter and an environmental datum provided from each of the indoor air conditioning apparatus 1 when the indoor air conditioning apparatuses 1 are in operation (S16). In one embodiment, the operating parameter includes a current wind speed and the environmental datum includes a current temperature of the area where the indoor air conditioning apparatus is installed. In another embodiment, the operating parameter further includes the comfortable temperature range.

After the step (S16), the control unit 3 updates an influence form which is previously built according to the operating parameters and the environmental data (S18). The detailed description of the influence form will be made hereinafter.

After the step (S16), the control unit 3 further determines whether there is any specific indoor air conditioning apparatus 1 that needs support according to the operating parameters and the environmental data (S20).

In one embodiment, when any one of the indoor air conditioning apparatuses 1 is operated at a maximum wind speed for a period of time and the ambient temperature of the area where the indoor air conditioning apparatus is installed cannot be adjusted in the comfortable temperature range, the indoor air conditioning apparatus is determined as the "specific" indoor air conditioning apparatus 1 by the control unit 3. In another embodiment, when one of the indoor air conditioning apparatuses 1 is operated at a wind speed which is excessively low (namely the ambient temperatures are imbalanced) relative to wind speeds of other indoor air conditioning apparatuses 1, the indoor air conditioning apparatus is determined as the "specific" indoor air conditioning apparatus 1 by the control unit 3.

If there is no any specific indoor air conditioning apparatus 1 that needs support (namely the ambient temperatures of all areas in the space 4 fall within the corresponding comfortable temperature ranges or the period time has not yet arrived), the control unit 3 continuously controls the indoor air conditioning apparatuses 1 to be in operation, receives the operating parameters and the environmental data provided from the indoor air conditioning apparatuses 1, updates the influence form, and determines whether there is any specific indoor air conditioning apparatus 1 that needs support.

If any one of the indoor air conditioning apparatuses 1 is the specific indoor air conditioning apparatus 1, the control unit 3 acquires an adjacent indoor air conditioning apparatus which is influential for the specific indoor air conditioning apparatus according to the influence form (S22). Therefore, the adjacent indoor air conditioning apparatus can be controlled by the control unit 3 to support the specific indoor air conditioning apparatus 1.

Afterward, the control unit 3 establishes a supportive strategy according to a supportable operation capability of the adjacent indoor air conditioning apparatus (S24). Also, the control unit 3 further adjusts the operating parameter of the adjacent indoor air conditioning apparatus according to the supportive strategy (S26).

As shown in FIG. 2, for example, if the control unit 3 determines that the first indoor air conditioning apparatus 11 is the specific indoor air conditioning apparatus, the control unit 3 identifies that the second indoor air conditioning apparatus 12 and the fifth indoor air conditioning apparatus 15 are the adjacent indoor air conditioning apparatuses according to the influence form. The control unit 3 establishes the supportive strategy according to a supportable operation capability of the second indoor air conditioning apparatus 12 and that of the fifth indoor air conditioning apparatus 15. The detailed description of the supportable operation capability will be made hereinafter.

After the step (S26), the control unit 3 calculates a waiting time and determines whether the ambient temperature of the area where the specific indoor air conditioning apparatus is installed is improved within the waiting time (S28). In other words, the control unit 3 determines whether the ambient temperature of the area where the specific indoor air conditioning apparatus is installed is within the comfortable temperature range. If the ambient temperature of the area where the specific indoor air conditioning apparatus is installed is within the comfortable temperature range, the specific indoor air conditioning apparatus restores to the general indoor air conditioning apparatus 1.

If the ambient temperature of the area where the specific indoor air conditioning apparatus is installed is not improved, the control unit 3 sends out a warning signal to notify a system administrator.

In one embodiment, the control unit 3 acquires several adjacent indoor air conditioning apparatuses which are influential for the specific indoor air conditioning apparatus in the step (S22), and the control unit 3 establishes several supportive strategies according to the supportable operation capabilities of the adjacent indoor air conditioning apparatuses in the step (S24). Therefore, the control unit 3 further determines whether there are other available supportive strategies when determining that the ambient temperature of the area where the specific indoor air conditioning apparatus is installed is not improved within the waiting time (S30).

If there are other available supportive strategies, the control unit 3 may use a new supportive strategy to replace the strategy which has been used and the new supportive strategy is used in the step (S26), thereby increasing the operation capability by using different adjustment manners. For example, different adjacent indoor air conditioning apparatuses are adjusted or the wind speed of the adjacent indoor air conditioning apparatus is increased. Moreover, the control unit 3 sends out the warning signal to notify the system administrator (S32) if there is no any available supportive strategy.

In one embodiment, the control unit 3 may determines whether the control system is powered off (S34). Also, the control unit 3 repeatedly performs the step (S14) to the step (S32) before the control system is powered off to continuously control the indoor air conditioning apparatuses 1.

Figure 4A:
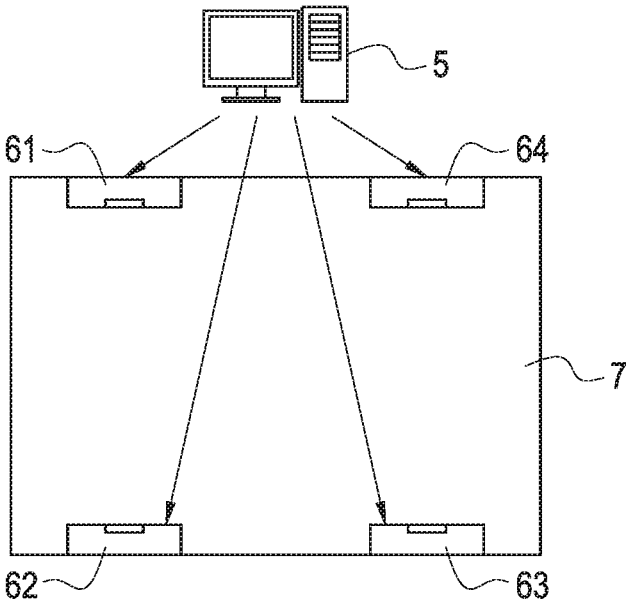
FIG. 4A is a schematic view of a first control operation according to the first embodiment of the present invention.
Figure 4B:
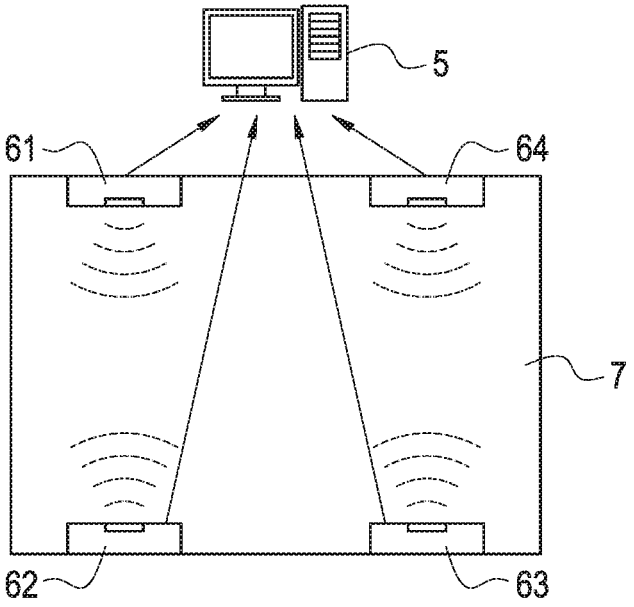
FIG. 4B is a schematic view of a second control operation according to the first embodiment of the present invention.

Refer to FIG. 4A to FIG. 4E, which show schematic views of first to fifth control operations according to the first embodiment of the present invention, respectively. As shown in FIG. 4A, the control unit 5 controls a first indoor air conditioning apparatus 61, a second indoor air conditioning apparatus 62, a third indoor air conditioning apparatus 63, and a fourth indoor air conditioning apparatus 64 installed in a space 7 to be in operation according to the target temperature and the comfortable temperature range after the control system is activated. Afterward, the indoor air conditioning apparatuses 61-64 continuously provide the operating parameters and the environmental data to the control unit 5 when the indoor air conditioning apparatuses 61-64 are in operation as shown in FIG. 4B.

Figure 4C:
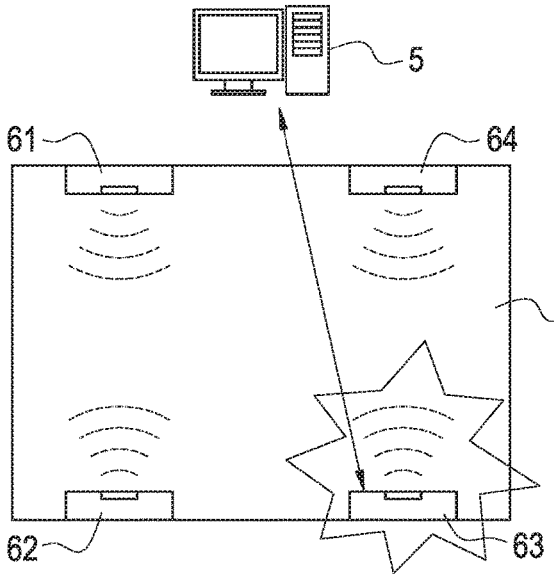
FIG. 4C is a schematic view of a third control operation according to the first embodiment of the present invention.
Figure 4D:
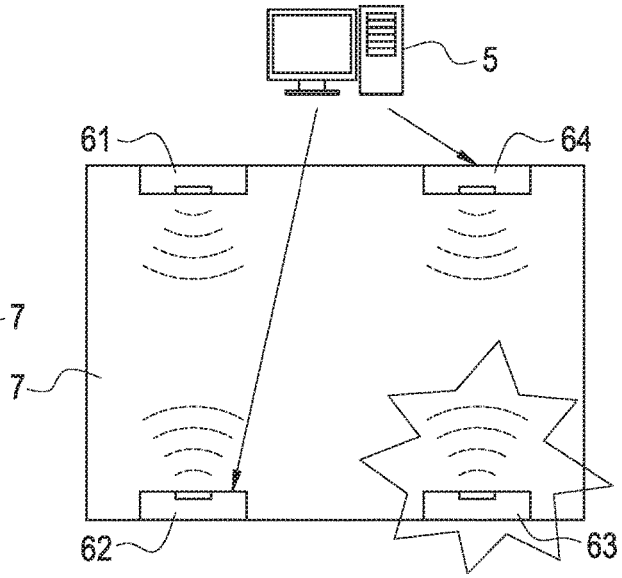
FIG. 4D is a schematic view of a fourth control operation according to the first embodiment of the present invention.

As shown in FIG. 4C, the control unit 5 determines that the third indoor air conditioning apparatus 63 is the specific indoor air conditioning apparatus that needs support according to the operating parameters and the environmental data. Afterward, the control unit 5 acquires that the second indoor air conditioning apparatus 62 and the fourth indoor air conditioning apparatus 64 are adjacent the specific indoor air conditioning apparatus and the adjacent indoor air conditioning apparatuses for the specific indoor air conditioning apparatus (namely the third indoor air conditioning apparatus 63) according to the influence form which is previously built.

Figure 4E:
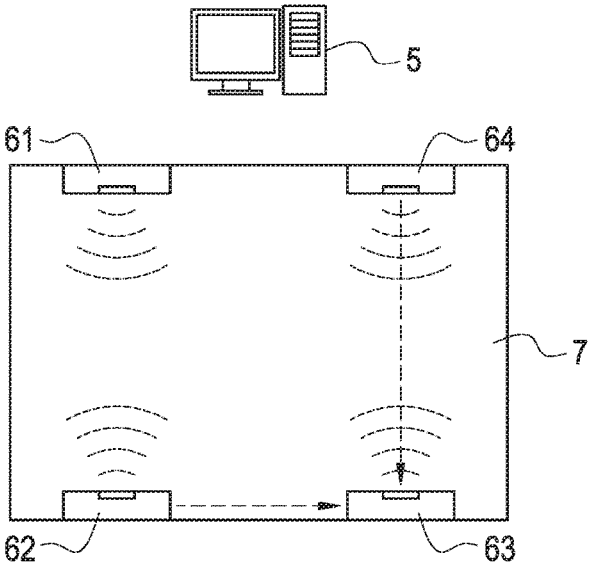
FIG. 4E is a schematic view of a fifth control operation according to the first embodiment of the present invention.

Finally, the control unit 5 establishes the supportive strategies according to the supportable operation capabilities of the adjacent indoor air conditioning apparatuses and adjusts the operating parameters of the adjacent indoor air conditioning apparatuses (namely the second indoor air conditioning apparatus 62 and the fourth indoor air conditioning apparatus 64) according to the supportive strategies as shown in FIG. 4E. Therefore, the second indoor air conditioning apparatus 62 and the fourth indoor air conditioning apparatus 64 are controlled to support the third indoor air conditioning apparatus 63 (namely the specific indoor air conditioning apparatus), thereby improving the ambient temperature of the area where the third indoor air conditioning apparatus 63 is installed.

As described above, the control unit 3/5 searches other indoor air conditioning apparatuses which are influential for the specific indoor air conditioning apparatus according to the influence form which is previously built after the specific indoor air conditioning apparatus is detected. Therefore, the influence form previously built mainly records several influence values of each of the indoor air conditioning apparatus 1 relative to other indoor air conditioning apparatuses 1.

Figure 5A:
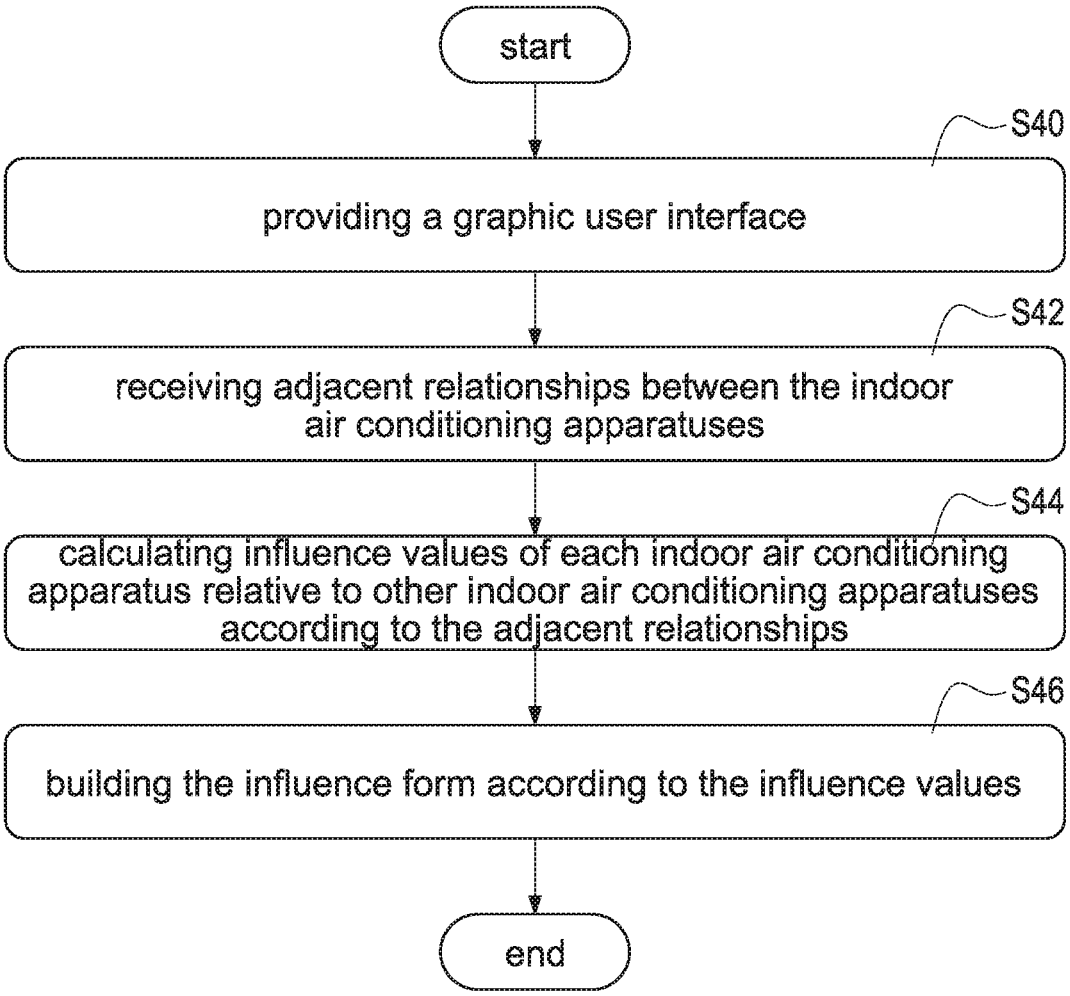
FIG. 5A is a flowchart of producing an influence form according to the first embodiment of the present invention.

Refer to FIG. 5A, which shows a flowchart of producing an influence form according to the first embodiment of the present invention. First, the control unit 3/5 provides a graphic user interface (GUI) (S40), wherein the graphic user interface may be, for example but not limited to, a physical interface, a virtual interface, a web interface. In one embodiment, the control unit 3/5 receives several adjacent relationships between the indoor air conditioning apparatuses, which are set by the user, through the graphic user interface (S42).

After the user sets the adjacent relationships, the control unit 3/5 calculates several influence values of each of the indoor air conditioning apparatus 1 relative to other indoor air conditioning apparatuses 1 according to the adjacent relationships (S44). In this embodiment, the influence values are zero (0) or one (1), where the zero of the influence value represents two indoor air conditioning apparatuses are not adjacent (namely two indoor air conditioning apparatuses have no influence on each other), and the one of the influence value represents two indoor air conditioning apparatuses are adjacent (namely two indoor air conditioning apparatuses have influence on each other). Finally, the control unit 3/5 builds the influence form according to the influence values (S46). In particular, the influence form may be shown as follows.

| | first IACA | second IACA | third IACA |
|---|---|---|---|
| first IACA | | 1 | 0 |
| second IACA | 1 | | 1 |
| third IACA | 0 | 1 | |

In the above-shown influence form, "IACA" is the abbreviation of the indoor air conditioning apparatus, that is, first IACA represents the first indoor air conditioning apparatus, and the rest may be deduced by analogy.

As can be seen in the above table, the first indoor air conditioning apparatus is adjacent to the second indoor air conditioning apparatus; the second indoor air conditioning apparatus is adjacent to both the first indoor air conditioning apparatus and the third indoor air conditioning apparatus; the third indoor air conditioning apparatus is adjacent to the second indoor air conditioning apparatus. According to the influence form, the control unit 3/5 can quickly query the influence values between the indoor air conditioning apparatuses 1.

Figure 5B:
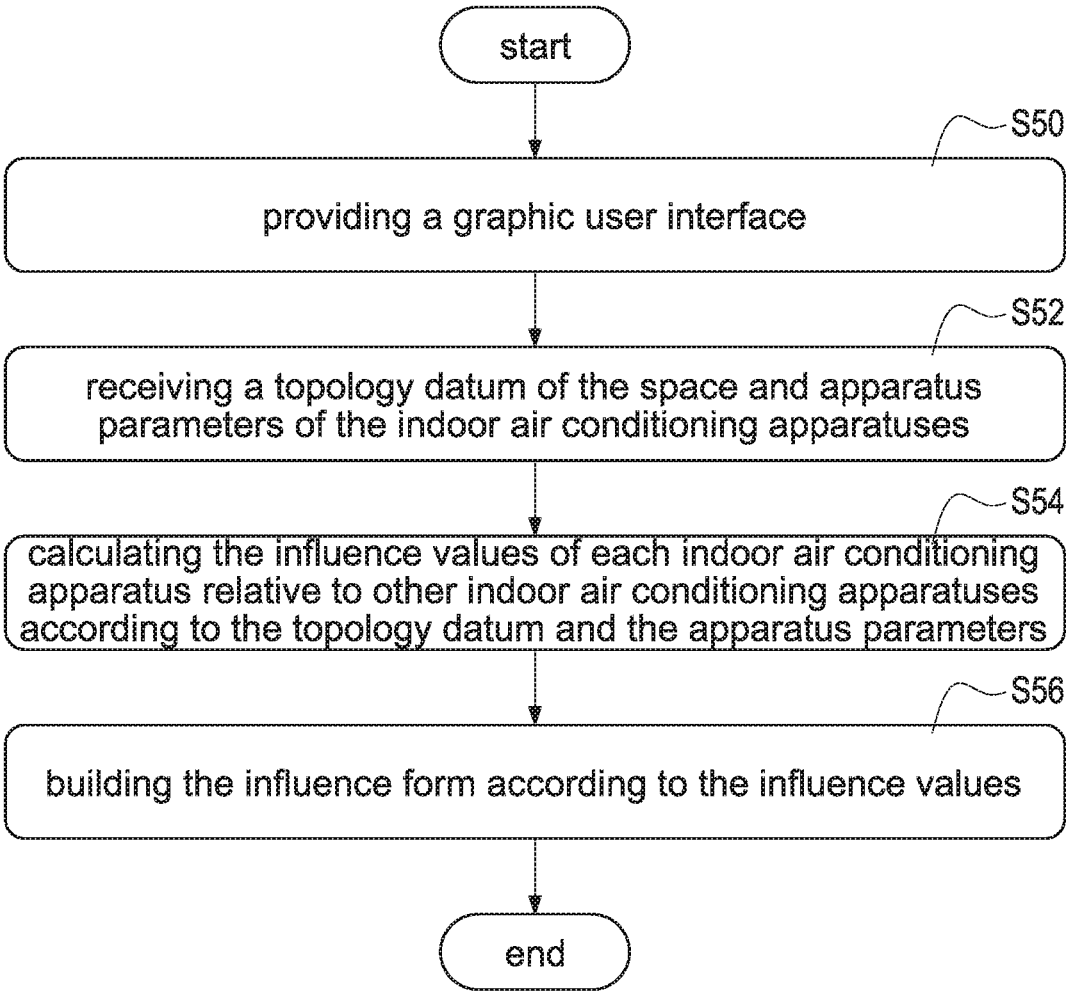
FIG. 5B is a flowchart of producing an influence form according to a second embodiment of the present invention.
Figure 5C:
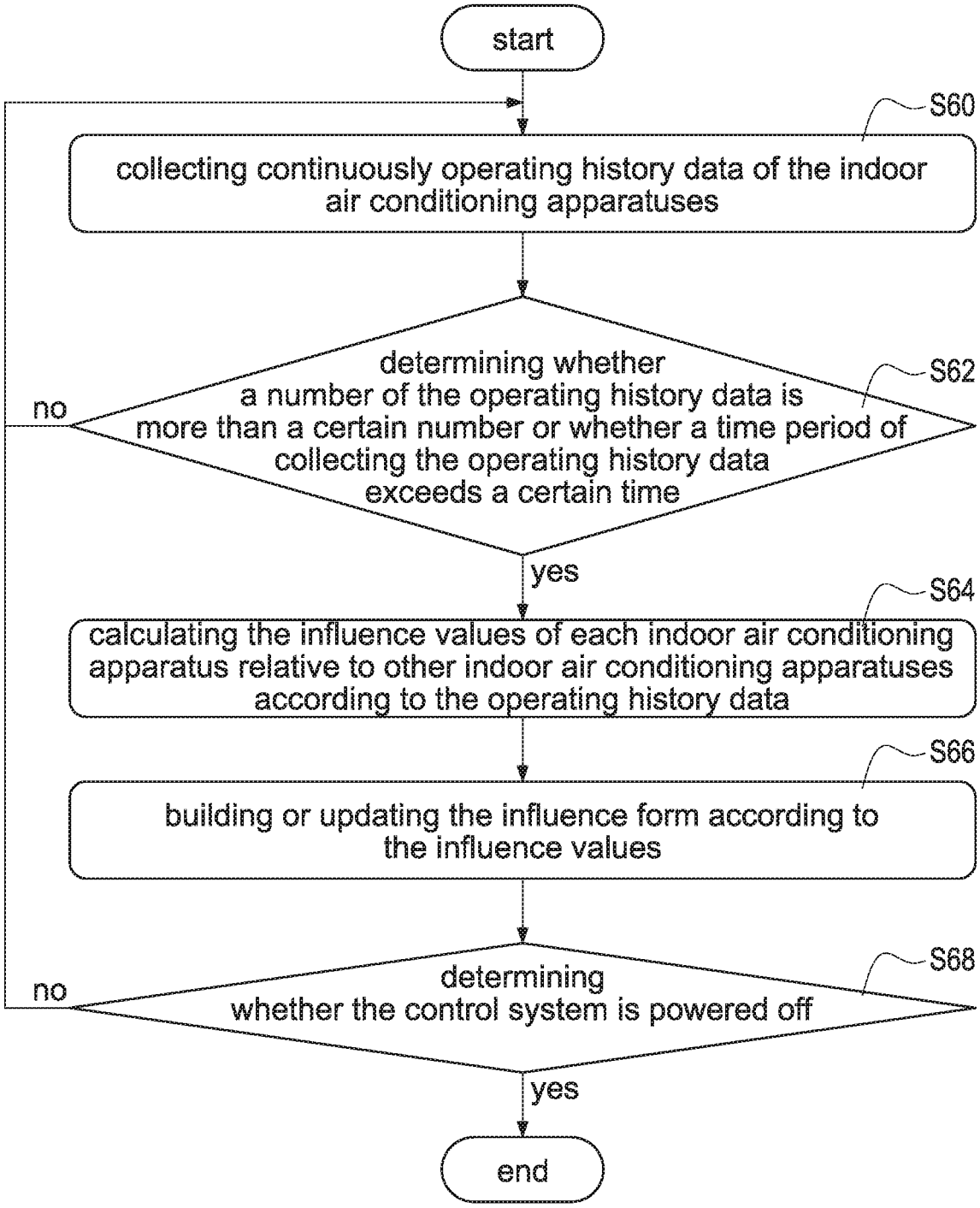
FIG. 5C is a flowchart of producing an influence form according to a third embodiment of the present invention.
Figure 5D:
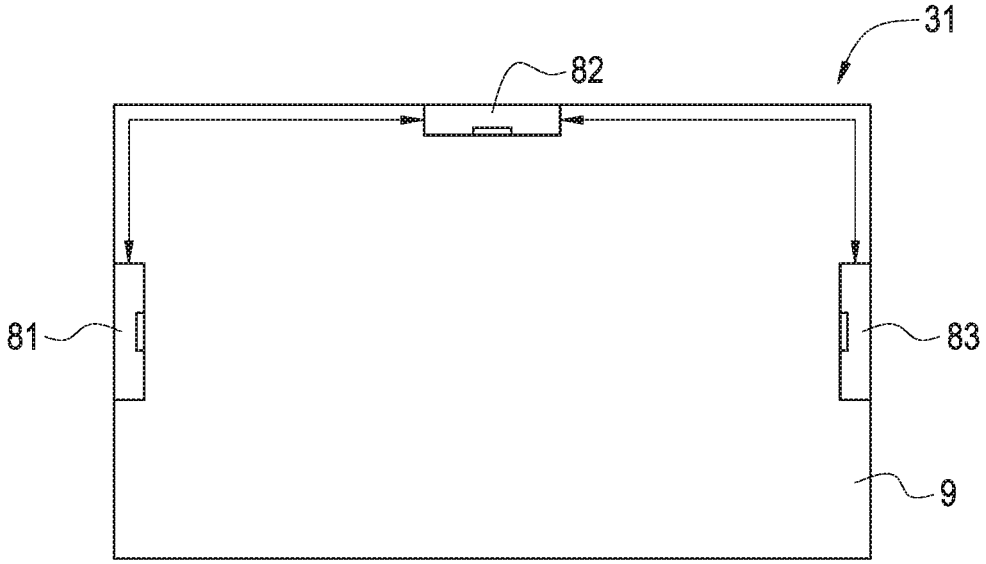
FIG. 5D is a schematic view of adjacent relationships according to the first embodiment of the present invention.

Refer to FIG. 5D, which shows a schematic view of adjacent relationships according to the first embodiment of the present invention. Before the influence form is built by the control unit 3/5, the graphic user interface 31 shows a configuration of the indoor air conditioning apparatuses installed in a space 9. In this embodiment, a first indoor air conditioning apparatus 81, a second indoor air conditioning apparatus 82, and a third indoor air conditioning apparatus are installed in the space 9.

In this embodiment, a positional relationship of the indoor air conditioning apparatuses can be recognized through the graphic user interface 31 by the user, and the user can set adjacent connections between the adjacent indoor air conditioning apparatuses on the graphic user interface 31 by the user's finger, a keyboard, or a mouse. As shown in FIG. 5D, the user sets an adjacent connection between the first indoor air conditioning apparatus 81 and the second indoor air conditioning apparatus 82, and sets another adjacent connection between the second indoor air conditioning apparatus 82 and the third indoor air conditioning apparatus 83. After the adjacent connections are completed by the user, the control unit 3/5 sets the influence value between the first indoor air conditioning apparatus 81 and the second indoor air conditioning apparatus 82 to one and also sets the influence value between the second indoor air conditioning apparatus 82 and the third indoor air conditioning apparatus 83 to one according to the adjacent connections, and the influence values are recorded in the influence form.

Accordingly, it is convenient and easy to build influence form by drawing lines on the graphic user interface 31 by the user.

FIG. 5B shows a flowchart of producing an influence form according to a second embodiment of the present invention. Referring to FIG. 5B. in the second embodiment, the control unit 3/5 provides another graphic user interface (S50) for the user to input a topology datum of the space and apparatus parameters of the indoor air conditioning apparatuses 1 (S52). In one embodiment, the topology datum records, for example but not limited to, the size, pattern, orientation, and decoration of the space and installation positions of the indoor air conditioning apparatuses 1. The apparatus parameter includes, for example but not limited to, the wind direction, cooling capability, heating capability, and improvable range of each of the indoor air conditioning apparatus 1.

After the topology datum and the apparatus parameters are acquired, the control unit 3/5 correspondingly calculates the influence values of each of the indoor air conditioning apparatus 1 relative to other indoor air conditioning apparatuses 1 according to the topology datum and the apparatus parameters (S54). In this embodiment, the influence values are rational numbers between and including zero and one, where the zero of the influence value represents two indoor air conditioning apparatuses are not adjacent (namely two indoor air conditioning apparatuses have no influence on each other), and the two indoor air conditioning apparatuses are more adjacent to each other (namely the influence between the two indoor air conditioning apparatuses is larger) as the influence value is closer to one. Finally, the control unit 3/5 builds the influence form according to the influence values (S56). In particular, the influence form may be shown as follows.

| | first IACA | second IACA | third IACA |
|---|---|---|---|
| first IACA | | 0.85 | 0.12 |
| second IACA | 0.85 | | 0.9 |
| third IACA | 0.12 | 0.9 | |

In the above-shown influence form, "IACA" is the abbreviation of the indoor air conditioning apparatus, that is, first IACA represents the first indoor air conditioning apparatus, and the rest may be deduced by analogy.

The influence form produced by the steps shown in FIG. 5B is similar to that produced by the steps shown in FIG. 5A, and a major difference between the two is that influence values in the influence form of the former may be rational numbers between zero and one including non-integers.

FIG. 5C shows a flowchart of producing an influence form according to a third embodiment of the present invention. Referring to FIG. 5C, the control unit 3/5 continuously collects operating history data of the indoor air conditioning apparatuses 1 after the control system is activated (S60). Also, the control unit 3 determines whether a number of the collected operating history data is more than a certain number or whether a time period of collecting the operating history data exceeds a certain time (S62). More specifically, the operating history data record the operating wind speeds at different time points and temperature variation values at that time of each of the indoor air conditioning apparatus 1. In particular, the operating history data may be shown as follows.

| date | time | wind speed of first IACA | temperature variation value |
|---|---|---|---|
| Jan. 1, 2017 | 01:01~01:10 | High | T1 |
| Jan. 1, 2017 | 01:11~01:20 | Middle | T2 |
| . . . | . . . | . . . | . . . |
| Jan. 1, 2017 | 01:51~02:00 | OFF | Tn |

In the above-shown operating history data, "IACA" is the abbreviation of the indoor air conditioning apparatus, that is, first IACA represents the first indoor air conditioning apparatus.

More specifically, the control unit 3 may correspondingly record the operating history data for each of the indoor air conditioning apparatus 1. When a number of the collected operating history data is more than the certain number or a time period of collecting the operating history data exceeds the certain time, the control unit 3 correspondingly calculates the influence values of each of the indoor air conditioning apparatus 1 relative to other indoor air conditioning apparatuses 1 according to the operating history data (S64). In this embodiment, the influence values are rational numbers between and including zero and one.

For example, the first indoor air conditioning apparatus is in operation at a high wind speed for ten minutes, and a temperature variation value is minus 2° C. in the ten minutes. On the next day at the same time, the first indoor air conditioning apparatus is in operation at a high wind speed for ten minutes, and a temperature variation value is minus 4° C. in the ten minutes. In this embodiment, the control unit 3 confirms whether there is any indoor air conditioning apparatus 1 that is in operation at the same time according to all recorded operating history data. If there is any indoor air conditioning apparatus 1 (such as the second indoor air conditioning apparatus) that is in operation at the same time, the control unit 3 determines that the second indoor air conditioning apparatus is influential for the first indoor air conditioning apparatus. In one embodiment, the control unit 3 may calculate the influence value according to a difference value of the temperature variation values.

After the step (S64), the control unit 3 builds the influence form according to the influence values, or updates the influence form built by the steps shown in FIG. 5A and/or FIG. 5B (S66). In the present invention, the control system may use one of the embodiments shown in FIG. 5A, FIG. 5B, and FIG. 5C to build the influence form, or simultaneously use the embodiments shown in FIG. 5A, FIG. 5B, and FIG. 5C to coordinate with predetermined weighting values to build the influence form.

Finally, the control unit 3 determines whether the control system is powered off (S68). Also, the control unit 3 repeatedly performs the step (S60) to the step (S66) before the control system is powered off to continuously update the influence form according to the latest operating history data.

As described above, if the control system uses the embodiments shown in FIG. 5B and/or FIG. 5C to build or update the influence form, the influence values in the influence form may be rational numbers between zero and one including non-integers. In one embodiment, the control unit 3 may perform an influence conversion procedure for the influence form before the control unit 3 searches the adjacent indoor air conditioning apparatuses for the specific indoor air conditioning apparatus through the influence form, thereby adjusting each influence value that is greater than or equal to a specific rational number, such as 0.75 to one (namely two indoor air conditioning apparatuses have influence on each other) and adjusting each influence value that is less than the specific rational number to zero (namely two indoor air conditioning apparatuses have no influence on each other). Accordingly, the processing speed of the control unit 3 can be increased.

Figure 6:
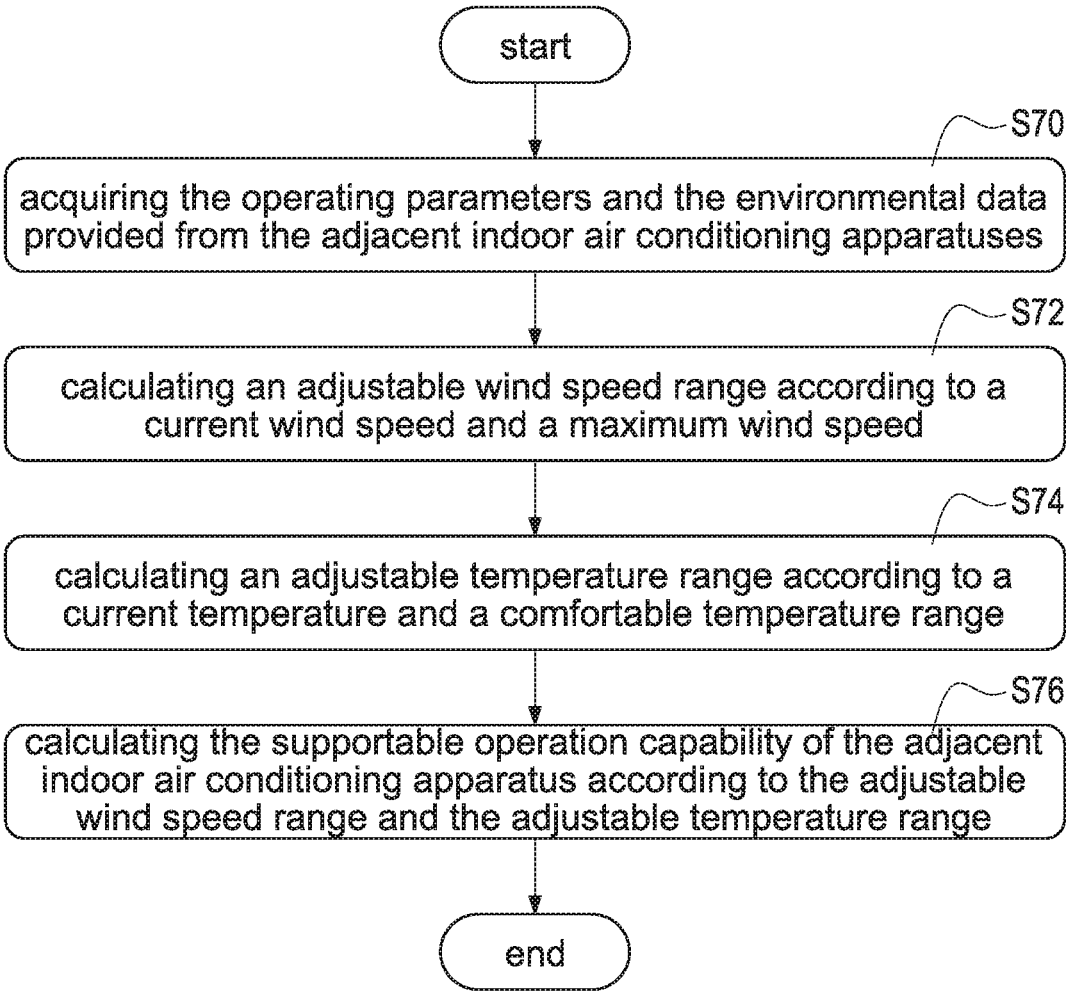
FIG. 6 is a flowchart of producing a supportable operation capability according to the first embodiment of the present invention.

FIG. 6 shows a flowchart of producing a supportable operation capability according to the first embodiment of the present invention. As shown in FIG. 3, the control unit 3 establishes the supportive strategies according to the supportable operation capabilities of the one or more than one adjacent indoor air conditioning apparatuses after the control unit 3 acquires one or more than one adjacent indoor air conditioning apparatuses which are influential for the specific indoor air conditioning apparatus according to an influence form. In the present invention, the control unit 3 calculates the supportable operation capabilities by these steps shown in FIG. 6. More specifically, the steps shown in FIG. 6 can be performed after the control unit 3 executes the above-mentioned embedded control codes.

In one embodiment, the control unit 3 may dynamically and continuously calculate the supportable operation capabilities of the indoor air conditioning apparatuses after the control system is activated, thereby increasing the speed of calculating the supportive strategies. In another embodiment, the control unit 3 calculates the supportable operation capabilities of the adjacent indoor air conditioning apparatuses after the control unit 3 acquires the adjacent indoor air conditioning apparatuses, thereby reducing the computing burden of the control unit 3. The detailed description of the supportable operation capability of the adjacent indoor air conditioning apparatus will be exemplified hereinafter for further demonstration.

More specifically, the control unit 3 acquires the operating parameters and the environmental data provided from the adjacent indoor air conditioning apparatuses before the control unit 3 calculates the supportable operation capabilities (S70). In one embodiment, the operating parameters record the current wind speeds and the comfortable temperature ranges of the adjacent indoor air conditioning apparatuses, and the environmental data record the current ambient temperatures of the area where the adjacent indoor air conditioning apparatuses are installed.

Afterward, the control unit 3 calculates an adjustable wind speed range of the adjacent indoor air conditioning apparatus according to the current wind speed and a maximum wind speed of the adjacent indoor air conditioning apparatus (S72). In one embodiment, the adjustable wind speed range ($\Delta P$) may be a difference value between the current wind speed and the maximum wind speed.

Figure 7A:
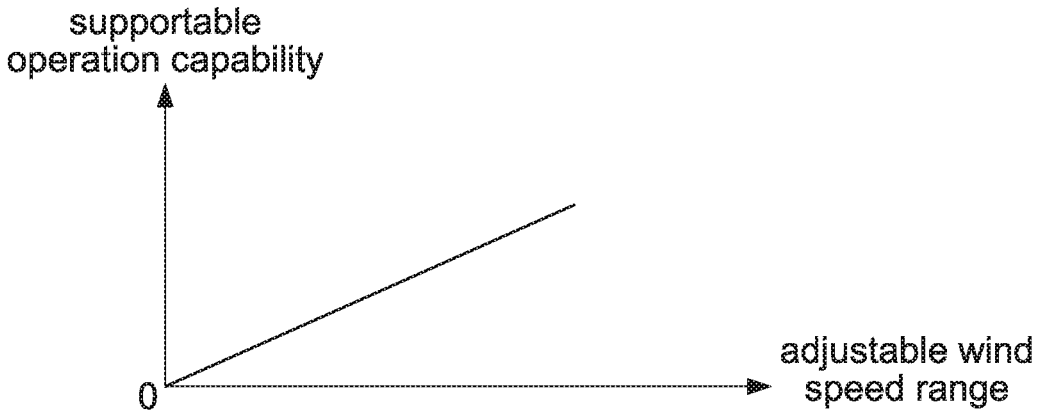
FIG. 7A is a schematic waveform of the supportable operation capability according to the first embodiment of the present invention.

FIG. 7A shows a schematic waveform of a supportable operation capability according to the first embodiment of the present invention. As shown in FIG. 7A, the supportable operation capability of the adjacent indoor air conditioning apparatus gets larger as the adjustable wind speed range ($\Delta P$) of the adjacent indoor air conditioning apparatus gets larger. For example, if the current wind speed of the adjacent indoor air conditioning apparatus is 20% and the maximum wind speed thereof is 100%, it represents that the adjustable wind speed range of the adjacent indoor air conditioning apparatus is 80%. If the current wind speed of the adjacent indoor air conditioning apparatus is 100%, the adjustable wind speed range thereof is 0%, that is, the supportable operation capability of the former (80%) is larger than that of the latter (0%). In other words, the 0% of the supportable operation capability represents that the adjacent indoor air conditioning apparatus has not been adjusted for the wind speed.

Referring to FIG. 6 again, the control unit 3 further calculates an adjustable temperature range of the adjacent indoor air conditioning apparatus according to the current temperature and the comfortable temperature range having an upper temperature and a lower temperature of the adjacent indoor air conditioning apparatus (S74) apart from the adjustable wind speed range. In one embodiment, the adjustable temperature range ($\Delta T$) may be a difference value between the current temperature and a temperature difference of the comfortable temperature range, where the temperature difference is equal to a difference value between the upper temperature and the lower temperature.

Figure 7B:
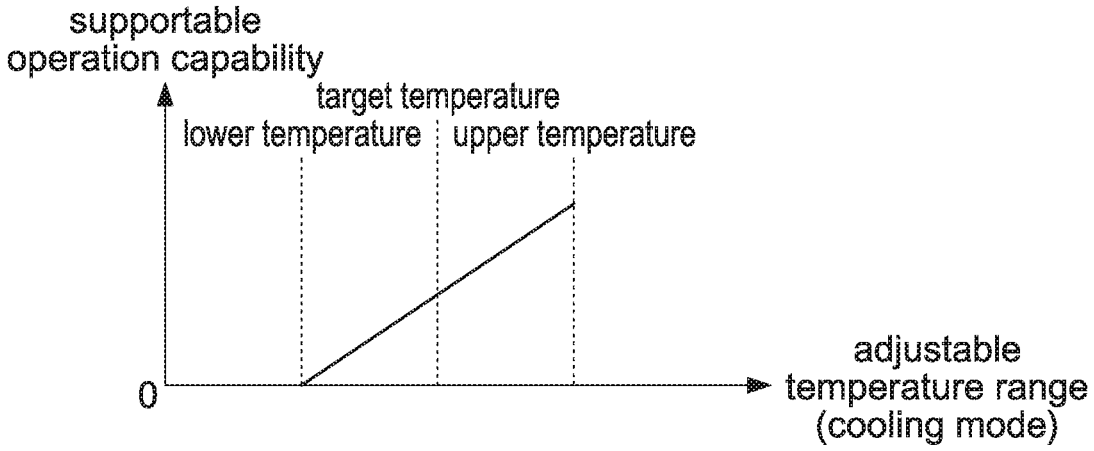
FIG. 7B is a schematic waveform of the supportable operation capability according to the second embodiment of the present invention.
Figure 7C:
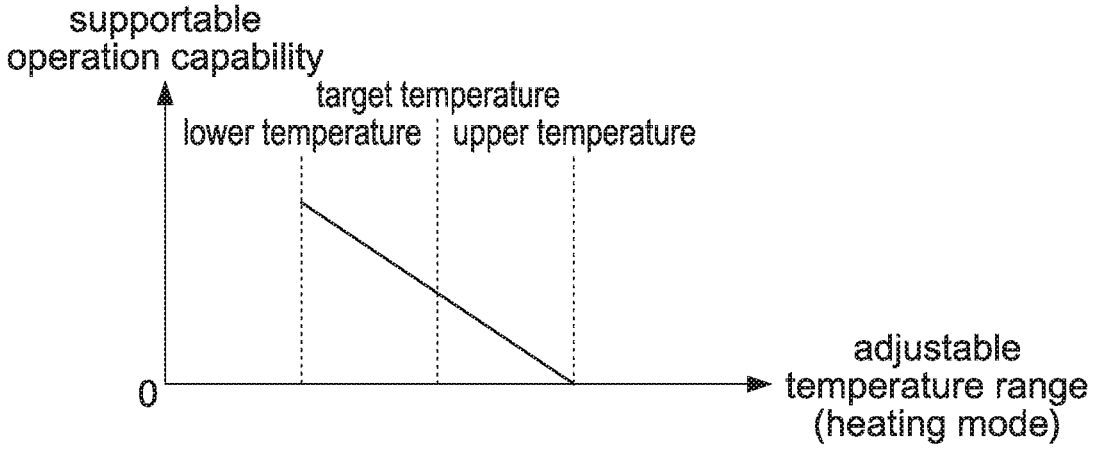
FIG. 7C is a schematic waveform of the supportable operation capability according to the third embodiment of the present invention.

FIG. 7B and FIG. 7C show schematic waveforms of the supportable operation capability according to the second embodiment and the third embodiment of the present invention, respectively. As shown in FIG. 7B, if the adjacent indoor air conditioning apparatus is operated in a cooling mode, the control unit 3 calculates a temperature difference value between the current temperature and the lower temperature of the comfortable temperature range, and the temperature difference value may be the adjustable temperature range ($\Delta T$) of the adjacent indoor air conditioning apparatus. As shown in FIG. 7C, if the adjacent indoor air conditioning apparatus is operated in a hating mode, the control unit 3 calculates a temperature difference value between the current temperature and the upper temperature of the comfortable temperature range, and the temperature difference value may be the adjustable temperature range ($\Delta T$) of the adjacent indoor air conditioning apparatus.

For example, it is assumed that the adjacent indoor air conditioning apparatus is operated in a cooling mode, the comfortable temperature range is 23.4° C. to 26.2° C., and the current temperature is 24.8° C., and therefore the lower temperature of the comfortable temperature range is 23.4° C. and the temperature difference is 1.4° C. (=24.8° C.−23.4° C.). In other words, the adjustable temperature range (ΔT) of the adjacent indoor air conditioning apparatus is 1.4° C., that is, the adjacent indoor air conditioning apparatus has the supportable operation capability to provide a temperature reduction of 1.4° C. For example, if the current temperature is 23.5° C., the temperature difference is 0.1° C. (=23.5° C.−23.4° C.). In this condition, the adjustable temperature range (ΔT) of the adjacent indoor air conditioning apparatus is 0.1° C., that is, the adjacent indoor air conditioning apparatus barely has the supportable operation capability to provide the temperature reduction.

In other words, when the adjacent indoor air conditioning apparatus is operated in the cooling mode and the ambient temperature of the area where the adjacent indoor air conditioning apparatus is installed is closer to the upper temperature of the comfortable temperature range as shown in FIG. 7B, the adjustable temperature range is winder. On the contrary, when the adjacent indoor air conditioning apparatus is operated in the heating mode and the ambient temperature of the area where the adjacent indoor air conditioning apparatus is installed is closer to the lower temperature of the comfortable temperature range as shown in FIG. 7C, the adjustable temperature range is winder.

Referring to FIG. 6 again, the control unit 3 may calculate the supportable operation capability of the adjacent indoor air conditioning apparatus according to the adjustable wind speed range and the adjustable temperature range after the control unit 3 acquires the adjustable wind speed range and the adjustable temperature range (S76). Therefore, the control unit 3 can determine how to support the specific indoor air conditioning apparatuses and establish the supportive strategies according to the supportable operation capabilities of one or more than one adjacent indoor air conditioning apparatuses.

The control unit 3, which is applied to the control system and the control method, is used to opportunely adjust the operating parameters of the indoor air conditioning apparatuses so that the ambient temperatures of the areas where the indoor air conditioning apparatuses 1 are installed can be correspondingly maintained in the comfortable temperature ranges. Moreover, the operating parameters of the indoor air conditioning apparatuses 1 can be adjusted to be coincident so as to reduce the overall power consumption of the control system.

Although the present invention has been described with reference to the preferred embodiment thereof, it will be understood that the present invention is not limited to the details thereof. Various substitutions and modifications have been suggested in the foregoing description, and others will occur to those of ordinary skill in the art. Therefore, all such substitutions and modifications are intended to be embraced within the scope of the present invention as defined in the appended claims.

What is claimed is:

1. A compensational control method applied to a compensational control system located in a space, the compensational control system comprising a control unit and a plurality of indoor air conditioning apparatuses connected to the control unit, the method comprising steps of:

(a0) building an influence form, wherein the influence form is configured to record a plurality of influence values of each of the indoor air conditioning apparatus relative to other indoor air conditioning apparatuses;

(a) controlling the indoor air conditioning apparatuses to be in operation by the control unit according to a target temperature and a comfortable temperature range;

(b) receiving continuously an operating parameter and an environmental datum provided from each of the indoor air conditioning apparatus, wherein the operating parameter includes a current wind speed of the indoor air conditioning apparatus and the comfortable temperature range, and the environmental datum includes a current temperature of an area where the indoor air conditioning apparatus is installed;

(c) determining whether there is a specific indoor air conditioning apparatus that needs support according to the operating parameters and the environmental data;

(d) acquiring an adjacent indoor air conditioning apparatus which is influential for the specific indoor air conditioning apparatus according to the influence form;

(e01) calculating a supportable operation capability of the adjacent indoor air conditioning apparatus according to the current wind speed, the comfortable temperature range of the adjacent indoor air conditioning apparatus, and the current temperature of the area where the adjacent indoor air conditioning apparatus is installed, the calculating step comprising:

(e011) acquiring the operating parameter and the environmental datum of the adjacent indoor air conditioning apparatus;

(e012) calculating an adjustable wind speed range of the adjacent indoor air conditioning apparatus according to the current wind speed and a maximum wind speed;

(e013) calculating an adjustable temperature range of the adjacent indoor air conditioning apparatus according to the current temperature and the comfortable temperature range; and (e014) calculating the supportable operation capability of the adjacent indoor air conditioning apparatus according to the adjustable wind speed range and the adjustable temperature range;

(e) establishing a supportive strategy according to the supportable operation capability of the adjacent indoor air conditioning apparatus, wherein the supportable operation capability is proportional to the adjustable wind speed range of the adjacent indoor air conditioning apparatus, and is also proportional to the adjustable temperature range of the area where the adjacent indoor air conditioning apparatus is arranged; and (f) adjusting the operating parameter of the adjacent indoor air conditioning apparatus according to the supportive strategy.

2. The compensational control method in claim 1, wherein the step (a0) comprises steps of:

(a011) providing a graphic user interface by the control unit;

(a012) receiving a plurality of adjacent relationships between the indoor air conditioning apparatuses through the graphic user interface;

(a013) calculating correspondingly the influence values of the indoor air conditioning apparatuses according to the adjacent relationships, wherein the influence values are zero or one; and (a014) building the influence form according to the influence values.

3. The compensational control method in, claim 1, wherein the step (a0) further comprises steps of:

(a021) providing a graphic user interface by the control unit;

(a022) receiving a topology datum of the space and an apparatus parameter of each of the indoor air conditioning apparatus;

(a023) calculating correspondingly the influence values of the indoor air conditioning apparatuses according to the topology datum and the apparatus parameters, wherein the influence values are rational numbers between zero and one; and (a024) building the influence form according to the influence values.

4. The compensational control method in claim 1, wherein the step (a0) further comprises steps of:

(a031) collecting an operating history datum of each of the indoor air conditioning apparatus by the control unit;

(a032) calculating correspondingly the influence values of the indoor air conditioning apparatuses according to the operating history data, wherein the influence values are rational numbers between zero and one; and (a033) building or updating the influence form according to the influence values; and (a034) performing repeatedly the step (a031), the step (a032), and the step (a033) before the compensational control system is powered off.

5. The compensational control method in claim 4, further comprising a step of:

(d1) performing an influence conversion procedure after the step (d), wherein the influence conversion procedure is to adjust each influence value that is greater than or equal to a specific rational number to one and adjust each influence value that is less than the specific rational number to zero.

6. The compensational control method in claim 1, wherein when the adjacent indoor air conditioning apparatus is operated in a cooling mode, a temperature difference value between the current temperature and a lower temperature of the comfortable temperature range is calculated, and the temperature difference value is equal to the adjustable temperature range in the step (e013).

7. The compensational control method in claim 1, wherein when the adjacent indoor air conditioning apparatus is operated in a heating mode, a temperature difference value between the current temperature and an upper temperature of the comfortable temperature range is calculated, and the temperature difference value is equal to the adjustable temperature range in the step (e013).

8. The compensational control method in claim 1, wherein in the step (c), when any one of the indoor air conditioning apparatuses is operated at a maximum wind speed for a period of time and an ambient temperature of the area where the indoor air conditioning apparatus is installed cannot be adjusted in the comfortable temperature range, the indoor air conditioning apparatus is determined as the specific indoor air conditioning apparatus.

9. The compensational control method in claim 1, further comprising steps of:

(g) calculating a waiting time after the step (f);

(h) determining whether the ambient temperature of the area where the specific indoor air conditioning apparatus is installed is improved within the waiting time; and (i) sending out a warning signal when the ambient temperature of the area where the specific indoor air conditioning apparatus is installed is not improved within the waiting time.

10. The compensational control method in claim 9, wherein in the step (d), the adjacent indoor air conditioning apparatuses which are influential for the specific indoor air conditioning apparatus are acquired according to the influence form; in the step (e), the supportive strategies are established according to the supportable operation capabilities of the adjacent indoor air conditioning apparatuses, and the step (i) further comprises steps of:

(i1) determining whether another of the supportive strategies is available when the ambient temperature of the area where the specific indoor air conditioning apparatus is installed is not improved;

(i2) performing the step (f) when another of the supportive strategies is available; and (i3) sending out the warning signal when another of the supportive strategies is not available.

11. A compensational control system for indoor air conditioning apparatuses applied to the compensational control method in claim 1, the compensational control system comprising:

a control unit configured to determine a target temperature to be reached for different areas in a space; and a plurality of indoor air conditioning apparatuses connected to the control unit and configured to receive the target temperature, each of the indoor air conditioning apparatus being in operation according to its target temperature and a comfortable temperature range, and continuously providing an operating parameter and an environmental datum to the control unit, wherein the operating parameter includes a current wind speed of the indoor air conditioning apparatus and the comfortable temperature range, and the environmental datum includes a current temperature of an area where the indoor air conditioning apparatus is installed;

wherein the control unit acquires an adjacent indoor air conditioning apparatus which is influential for the specific indoor air conditioning apparatus according to an influence form which is previously built when the control unit determines one of the indoor air conditioning apparatuses that needs support according to the operating parameters and the environmental data;

wherein the control unit is configured to calculate an adjustable wind speed range of the adjacent indoor air conditioning apparatus according to a difference value between the current wind speed and a maximum wind speed, to calculate an adjustable temperature range of the adjacent indoor air conditioning apparatus according to a difference value between the current temperature and an upper temperature or a lower temperature of the comfortable temperature range, to calculate a supportable operation capability of the adjacent indoor air conditioning apparatus according to the adjustable wind speed range and the adjustable temperature range, to establish a supportive strategy according to the supportable operation capability of the adjacent indoor air conditioning apparatus, and to adjust the operating parameter of the adjacent indoor air conditioning apparatus according to the supportive strategy, wherein the supportable operation capability is proportional to the adjustable wind speed range of the adjacent indoor air conditioning apparatus, and is also proportional to the adjustable temperature range of the area where the adjacent indoor air conditioning apparatus is arranged.

12. The compensational control system in claim 11, wherein the control unit is configured to provide a graphic user interface, and the graphic user interface is configured to receive a plurality of adjacent relationships between the indoor air conditioning apparatuses; the control unit is configured to correspondingly calculate a plurality of influence values of the indoor air conditioning apparatuses according to the adjacent relationships, and build the influence form according to the influence values, wherein the influence values are rational numbers between zero and one.

13. The compensational control system in claim 11, wherein the control unit is configured to provide a graphic user interface, and the graphic user interface is configured to receive a topology datum of the space and an apparatus parameter of each of the indoor air conditioning apparatus; the control unit is configured to correspondingly calculate a plurality of influence values of the indoor air conditioning apparatuses according to the topology datum and the apparatus parameters, and build the influence form according to the influence values, wherein the influence values are rational numbers between zero and one.

14. The compensational control system in claim 11, wherein the control unit is configured to collect an operating history datum of each of the indoor air conditioning apparatus, correspondingly calculate a plurality of influence values of the indoor air conditioning apparatuses according to the operating history data, and build or update the influence form according to the influence values, wherein the influence values are rational numbers between zero and one.

* * * * *